US007767154B2

(12) United States Patent
Nichols et al.

(10) Patent No.: US 7,767,154 B2
(45) Date of Patent: Aug. 3, 2010

(54) MICROPLATE KIT

(75) Inventors: Michael J. Nichols, Roslindale, MA (US); Louis J. Guarracina, Topsfield, MA (US)

(73) Assignee: HighRes Biosolutions, Inc., Woburn, MA (US)

( * ) Notice: Subject to any disclaimer, the term of this patent is extended or adjusted under 35 U.S.C. 154(b) by 80 days.

(21) Appl. No.: 12/008,829

(22) Filed: Jan. 14, 2008

(65) Prior Publication Data

US 2008/0193338 A1 Aug. 14, 2008

Related U.S. Application Data

(60) Provisional application No. 60/880,173, filed on Jan. 12, 2007.

(51) Int. Cl.
*B01L 3/00* (2006.01)

(52) U.S. Cl. ..... 422/102; 422/63; 422/65; 422/66; 422/67; 422/99; 436/47; 436/43; 436/48; 294/15; 294/16; 294/17; 294/131; 206/710; 206/711

(58) Field of Classification Search ..... 422/102; 294/15, 16, 17, 131; 436/47, 43, 48; 206/710, 206/711

See application file for complete search history.

(56) References Cited

U.S. PATENT DOCUMENTS

| | | | | | |
|---|---|---|---|---|---|
| 747,181 | A | * | 12/1903 | Jackson et al. | 294/62 |
| 4,040,234 | A | | 8/1977 | Stockdale et al. | |
| 4,482,182 | A | * | 11/1984 | Mortensen | 294/15 |
| 4,963,493 | A | | 10/1990 | Daftsios | |
| 5,342,581 | A | | 8/1994 | Sanadi | |
| 5,516,490 | A | | 5/1996 | Sanadi | |
| 5,587,321 | A | | 12/1996 | Smith et al. | |
| 5,741,463 | A | | 4/1998 | Sanadi | |
| 5,842,573 | A | | 12/1998 | Halvorsen | |
| 5,854,065 | A | | 12/1998 | Livingston et al. | |
| 5,910,287 | A | | 6/1999 | Cassin et al. | |
| 6,021,917 | A | | 2/2000 | Lovell et al. | |
| 6,171,780 | B1 | | 1/2001 | Pham et al. | |
| 6,254,833 | B1 | | 7/2001 | Shumate et al. | |
| 6,258,325 | B1 | | 7/2001 | Sanadi | |
| 6,426,050 | B1 | | 7/2002 | Pham et al. | |
| 6,426,215 | B1 | | 7/2002 | Sandell | |
| 6,436,351 | B1 | | 8/2002 | Gubernator et al. | |
| 6,486,401 | B1 | | 11/2002 | Warhurst et al. | |
| 6,534,014 | B1 | | 3/2003 | Mainquist et al. | |
| 6,543,203 | B2 | | 4/2003 | Thompson et al. | |

(Continued)

*Primary Examiner*—Jill Warden
*Assistant Examiner*—Sally A Sakelaris
(74) *Attorney, Agent, or Firm*—Hoffman Warnick LLC

(57) ABSTRACT

A reusable microplate kit for use in the life sciences industry includes a microplate and a removable lid. The microplate includes a sample area with a plurality of individual wells and a hollow outer frame formed around the sample area, the frame being shaped to include a plurality of openings in its top surface. The lid includes a plate, a plurality of latches formed on the underside of the plate and a compressible gasket affixed to the underside of the plate. In use, the lid is mounted on the microplate by inserting each latch through a corresponding opening until the latch snaps into engagement with the frame. In this manner, the plate and gasket together serve to seal off each well from the outside environment. The microplate kit additionally includes a tool for disengaging the lid from the microplate and thereby assist in their separation.

17 Claims, 16 Drawing Sheets

U.S. PATENT DOCUMENTS 6,602,704 B1 8/2003 Maxwell et al.
6,669,911 B1 12/2003 Swanson
6,716,350 B2 4/2004 Olivier et al.
6,825,042 B1 * 11/2004 Shumate et al. ..... 506/43
6,861,035 B2 3/2005 Pham et al.
6,896,848 B1 5/2005 Warhurst et al.
6,918,738 B2 7/2005 Lafferty et al.
6,939,516 B2 9/2005 Hall et al.
2005/0019225 A1 * 1/2005 Sanadi ..... 422/102
2007/0020152 A1 1/2007 Costello, III et al.
2007/0172395 A1 7/2007 Lim et al.
2007/0258864 A1 11/2007 Braymer et al.

* cited by examiner

MICROPLATE KIT

CROSS-REFERENCE TO RELATED APPLICATIONS

The present application claims the benefit under 35 U.S.C. 119(e) of U.S. provisional Patent Application Ser. No. 60/880,173, filed on Jan. 12, 2007, the disclosure of which is incorporated herein by reference.

BACKGROUND OF THE INVENTION

The present invention relates generally to microplates that are typically used in the life sciences industry and more particularly to removable lids for sealing said microplates.

In the areas of biological, chemical and pharmaceutical research, it is a common practice to utilize microplates for storage and analytical purposes. Microplates (also commonly referred to in the art as multi-well plates, specimen plates and microtitre plates) have a block-shaped design and include a plurality of wells (e.g., 1, 2, 4, 6, 12, 24, 48, 96, 384, 1536, etc.) in its top surface, each well serving as an individualized receptacle for retaining a particular specimen.

It is well known in the art to seal the top surface of conventional microplates in order to, among other things, minimize the risk of contamination, degradation, moisture absorption and/or evaporation of specimens retained within each well. Presently, there are a number of different means for sealing conventional microplates.

As an example, it is well known for a foil seal to be affixed to the top surface of a microplate using a thermally activated adhesive. In order to access a particular well in the microplate after the foil seal has been applied (e.g., to retrieve a specimen retained therein), a laboratory technician either manually removes (i.e., peels off) at least a portion of the foil seal or punctures the portion of the foil that directly covers the particular well using a separate seal-piercing instrument.

Although widely used in the art, the use of a foil seal to enclose a microplate introduces a number of notable shortcomings. As a first shortcoming, it has been found to be rather difficult to adhere a secondary foil layer on a microplate after the primary foil layer has been removed or pierced, thereby precluding reuse of the microplate, which is highly undesirable. As a second shortcoming, it has been found to be rather difficult to determine the exact location of an individual well in a high density microplate (e.g., microplates with at least 1536 wells) through the foil seal. Accordingly, prior to locating the selected well using the foil piercing instrument, a laboratory technician often accidentally pierces the portion of the foil seal which directly covers one or more neighboring wells, which is highly undesirable.

As another example, in U.S. Pat. No. 6,534,014 to J. K. Mainquist et al, which is hereby incorporated by reference, there is disclosed a specimen plate lid that includes a sealing perimeter. In use, the lid is weighted so that when positioned on the specimen plate, the considerable weight of the lid compresses the seal against the sealing surface on the specimen plate.

Although known in the art, the lid described in the '014 patent suffers from two notable shortcomings. As a first shortcoming, the considerable weight associated with such a lid renders it difficult to use with most robots used in the life sciences market for picking and placing microtitre plates. As a second shortcoming, the footprint of such a lid is typically larger than the industry standard, thereby precluding its use with standard industry stackers, carousels and incubators.

As another example, in U.S. Pat. No. 6,939,516 to J. P. Hall et al., which is incorporated herein by reference, there is disclosed a multi-well plate cover that includes a lid and a gasket. The lid is formed of a resilient material and configured to apply a compressive spring force to the surface of the gasket to seal the wells in a multi-well plate when the cover is secured to the multi-well plate. The lid has members for mechanical manipulation and for attachment to the multi-well plate.

Although known in the art, the lid described in the '516 patent suffers from a notable shortcoming. Specifically, the lid described in the '516 patent is mechanically complex in nature. As a result, such a lid requires complicated and expensive machinery to assist in its sealing/removal through automated means, which is highly undesirable.

Other patents of interest include U.S. Pat. No. 6,254,833 to C. Shumate et al., and U.S. Pat. No. 6,543,203 to S. Thompson et al., both of these references being incorporated herein by reference.

SUMMARY OF THE INVENTION

It is an object of the present invention to provide a new and improved microplate kit which includes a microplate shaped to include a plurality of wells and a removable lid for enclosing the plurality of wells.

It is another object of the present invention to provide a microplate kit as described above which further includes a tool for assisting in the removal of the lid from the microplate.

It is still another object of the present invention to provide a microplate kit as described above which is reusable.

It is yet another object of the present invention to provide a microplate kit as described above which is both weighted and dimensioned for automated use.

It is yet still another object of the present invention to provide a microplate kit as described above includes a limited number of parts, which is easy to use and which is inexpensive to manufacture.

Accordingly, there is provided a microplate kit comprising (a) a microplate, the microplate comprising a sample area shaped to define a plurality of individual wells, and (b) a lid adapted to be mounted on the microplate to enclose the plurality of individual wells, (c) wherein at least one of the microplate and the lid is shaped to include an opening, (d) wherein the other of the microplate and the lid includes a projection dimensioned to project at least partially through the opening when the lid is mounted on the microplate.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the present invention and, together with the description, serve to explain the principles of the invention. In the drawings, wherein like reference numerals represent like parts.

DETAILED DESCRIPTION OF THE INVENTION

Figure 1:
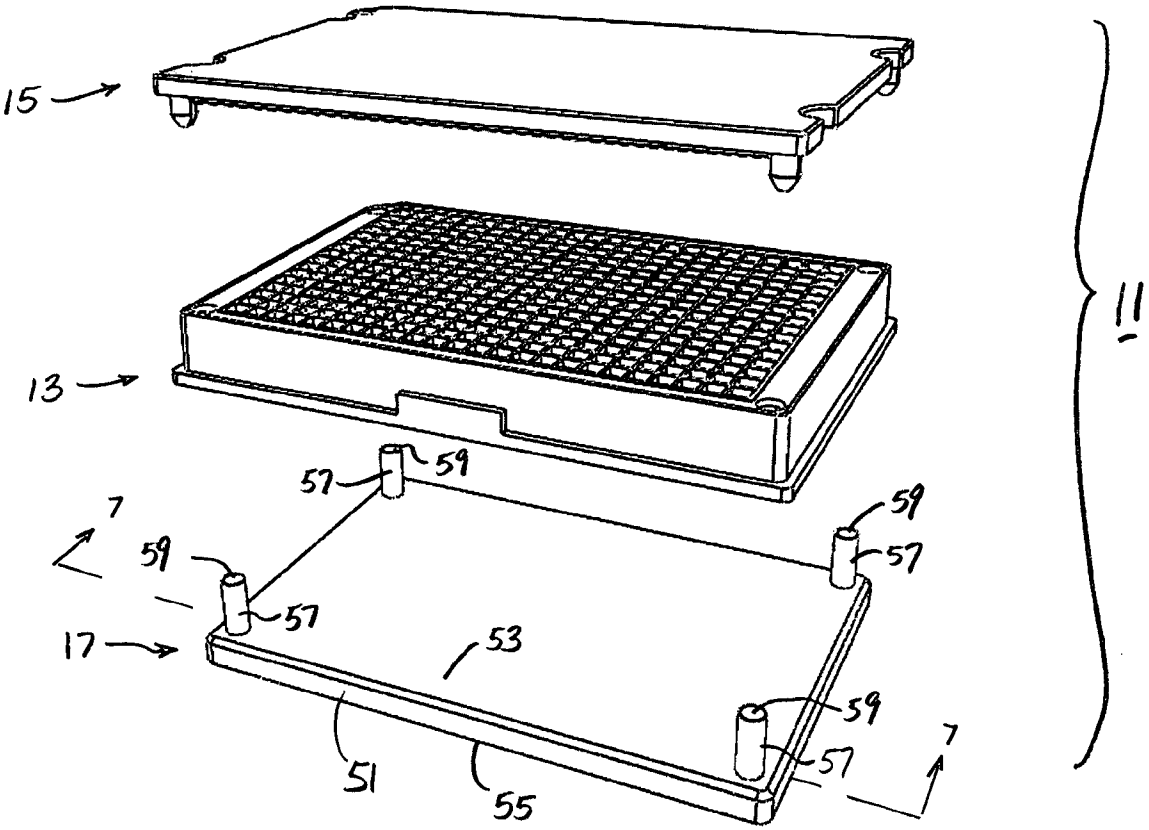
FIG. 1 is an exploded, top perspective view of a first embodiment of a microplate kit constructed according to the teachings of the present invention.

Referring now to FIG. 1, there is shown an exploded, top perspective view of a first embodiment of a microplate kit that is constructed according to the teachings of the present invention and identified generally by reference numeral 11.

Microplate kit 11 comprises a microplate 13, a lid 15 and a lid removal tool 17. As will be described in detail below, lid 15 is designed to be mounted on microplate 13. Tool 17 is designed to assist in the removal (i.e., or delidding) of lid 15 when mounted on microplate 13.

Figure 2:
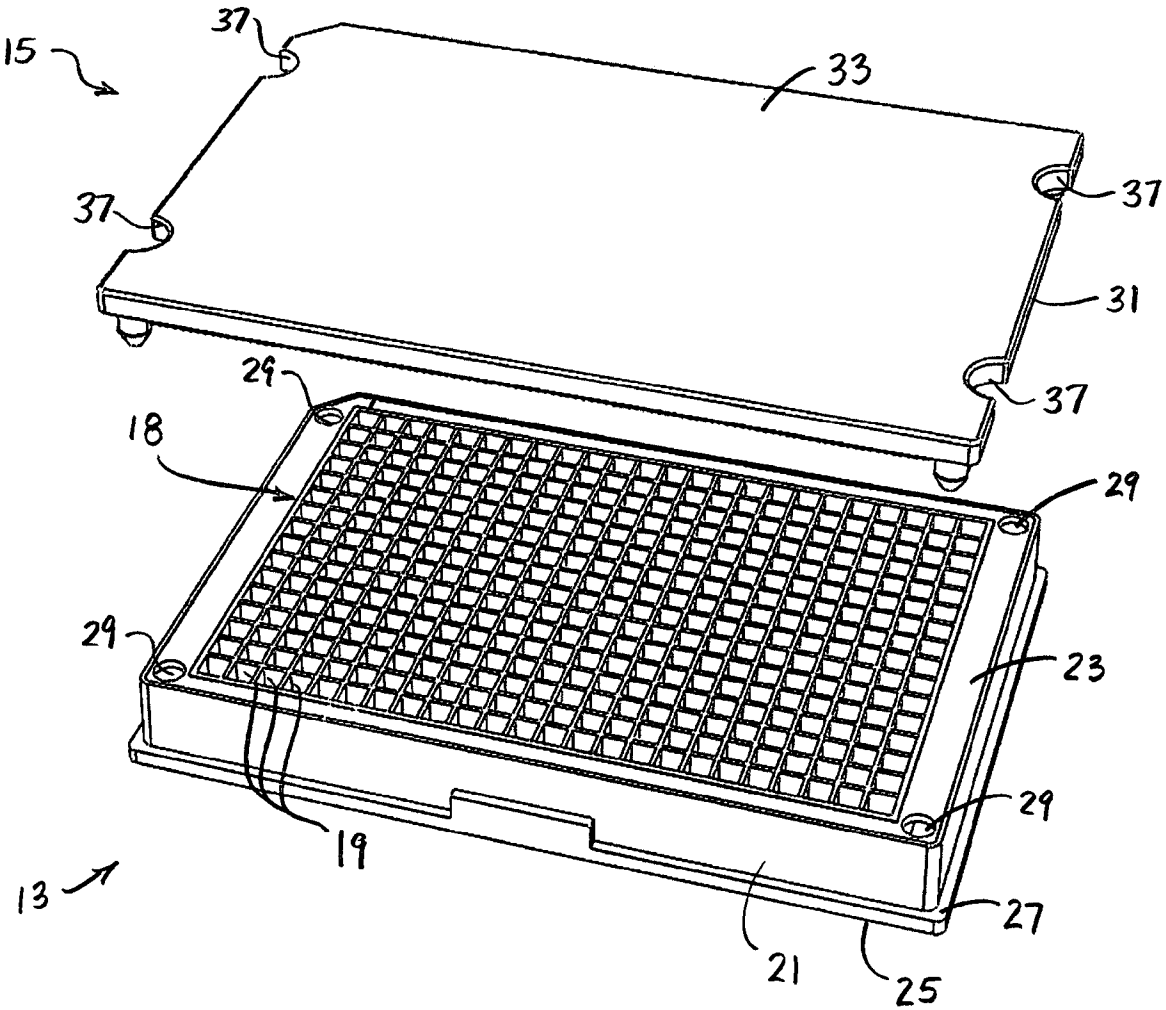
FIG. 2 is an exploded, top perspective view of the microplate and lid shown in FIG. 1.

Referring now to FIG. 2, microplate 13 has a generally block-shaped design and includes an enlarged sample area 18 that is provided with a plurality of individual, vertically-disposed wells 19. In the present embodiment, microplate 13 is represented as having 384 wells. However, it is to be understood that the present invention is not limited to any particular density of wells 19. Rather, the number of wells 19 could be modified to any density without departing from the spirit of the present invention (e.g., 96, 1536 or even greater than 1536 wells).

Figure 5A:
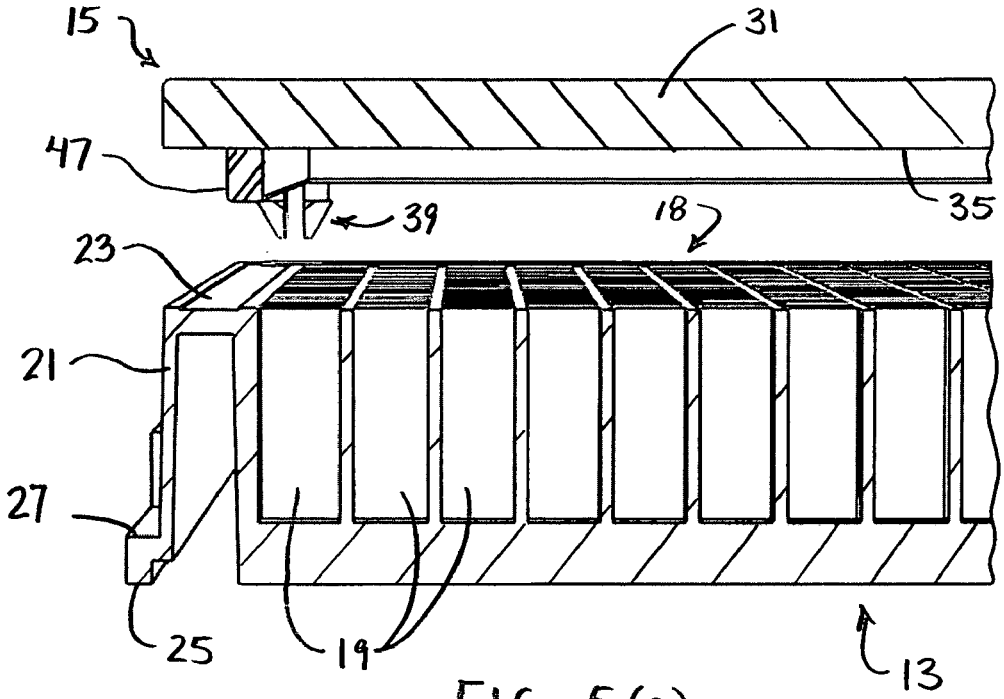
FIGS. 5(*a*) and 5(*b*) are fragmentary section views of the microplate and lid shown in FIG. 4(*a*), taken along lines 5-5, at various stages during the process of mounting the lid onto the microplate.
Figure 5B:
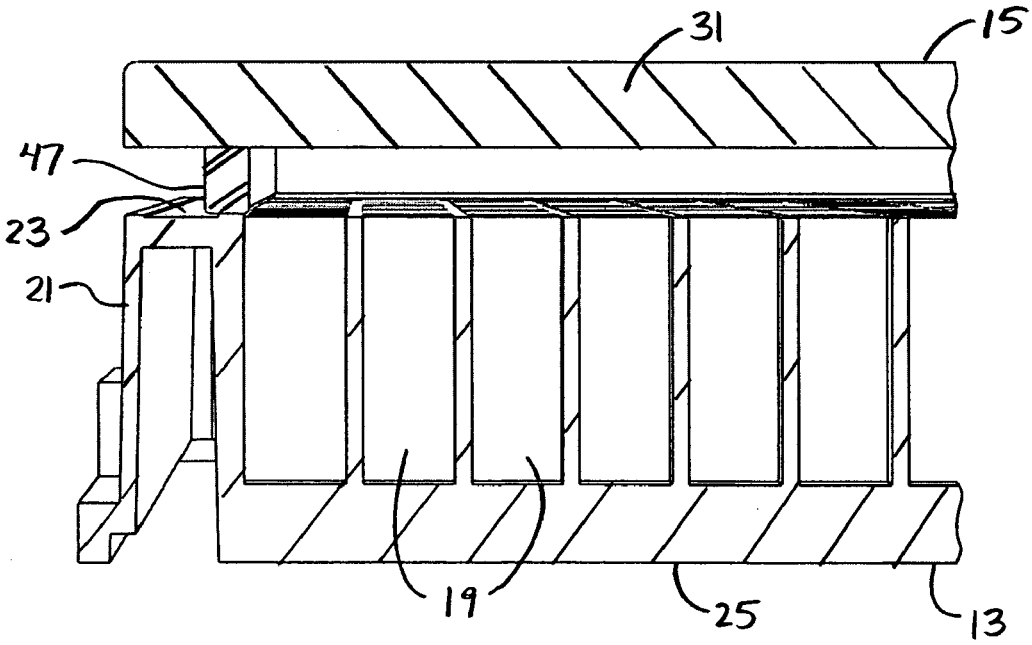

A hollow outer frame, or sidewall, 21 is formed directly around the periphery of sample area 18, sidewall 21 having an inverted U-shaped configuration in lateral cross-section (as seen most clearly in FIG. 5(*a*)). Sidewall 21 is shaped to define a thin, substantially flat top surface 23, a substantially open bottom surface 25 and an outwardly extending registration edge, or flange, 27 along bottom surface 25. As can be appreciated, registration edge 27 facilitates the accurate positioning of microplate 13 in an automated environment.

Sidewall 21 is additionally shaped to define a plurality of vertically disposed openings, or holes, 29 in top surface 23, with one hole 29 located in each corner of sidewall 21, as seen most clearly in FIG. 2. It should be noted that each hole 29 is generally circular in lateral cross-section, extends completely through top surface 23 and is accessible from the underside of microplate 13 (i.e., through substantially open bottom surface 25). As will be described further in detail below, lid 15 is releasably secured to microplate 13 through holes 29.

Figure 3:
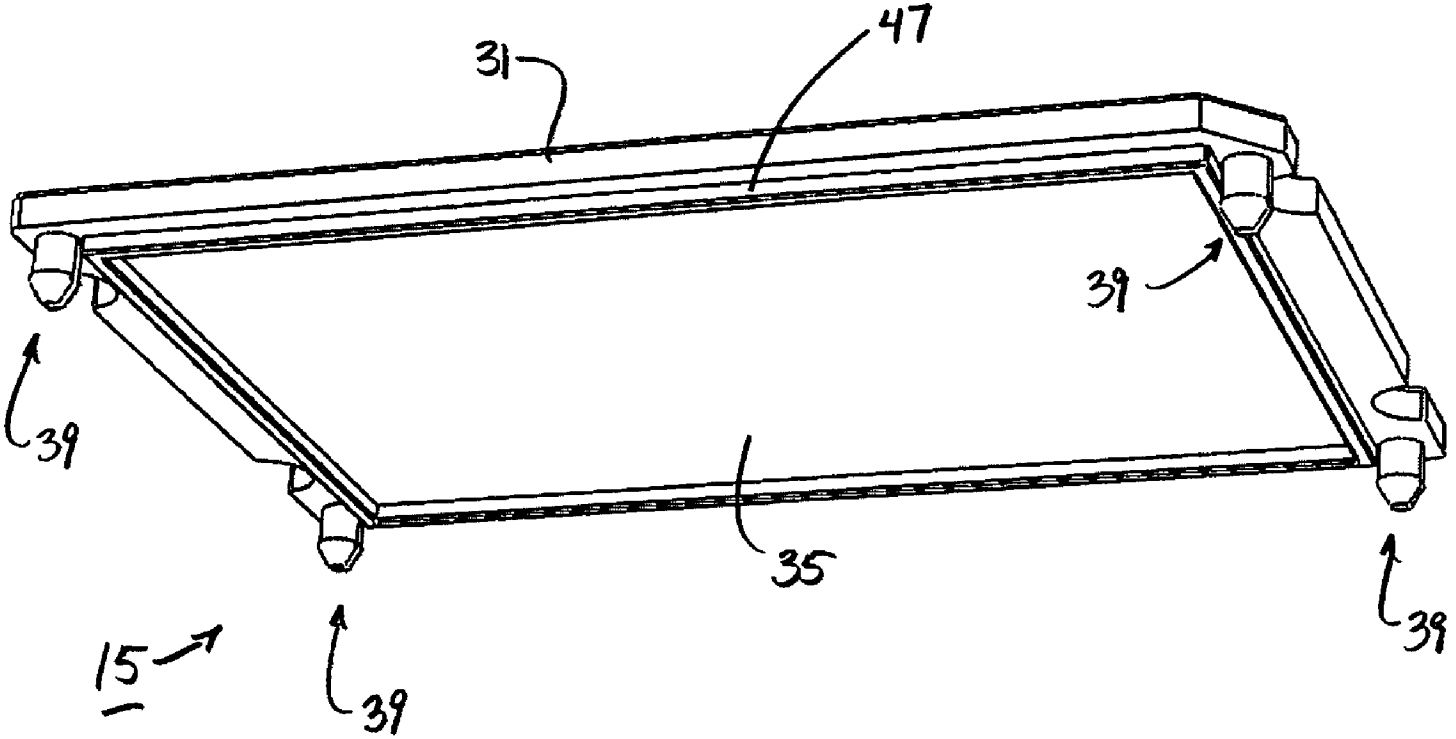
FIG. 3 is a bottom perspective view of the lid shown in FIG. 2.

As seen most clearly in FIGS. 2 and 3, lid 15 preferably comprises a thin, generally rectangular plate 31 which includes a substantially flat top surface 33 and a substantially flat bottom surface 35. Preferably, a plurality of arcuate notches 37 are formed along the outer edge of plate 31 to (i) facilitate handling of lid 15 and (ii) provide access to top surface 23 of sidewall 21 when lid 15 is mounted on microplate 13, as will described in further detail below.

Figure 4A:
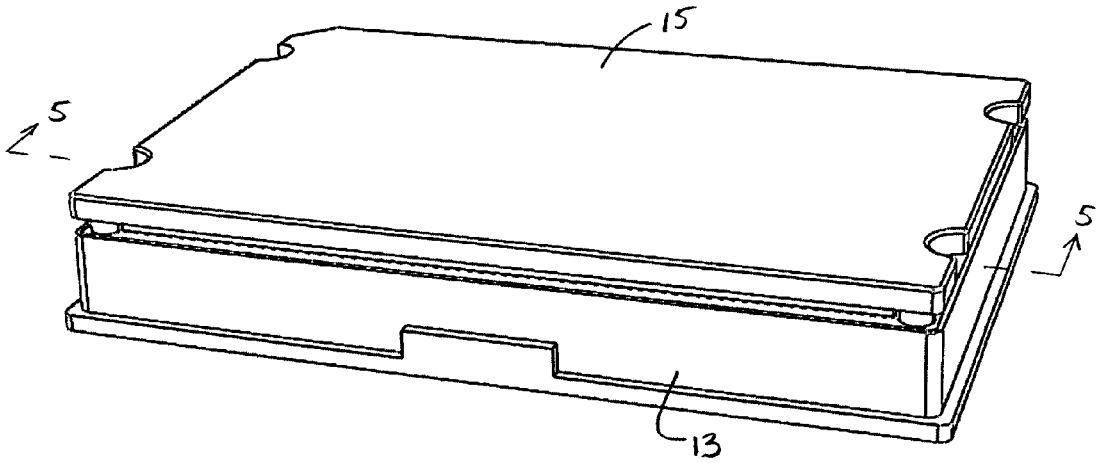
FIGS. 4(*a*) and 4(*b*) are front, top perspective and left end, top perspective views, respectively, of the microplate and lid shown in FIG. 2, the lid being shown mounted on the microplate.
Figure 4B:
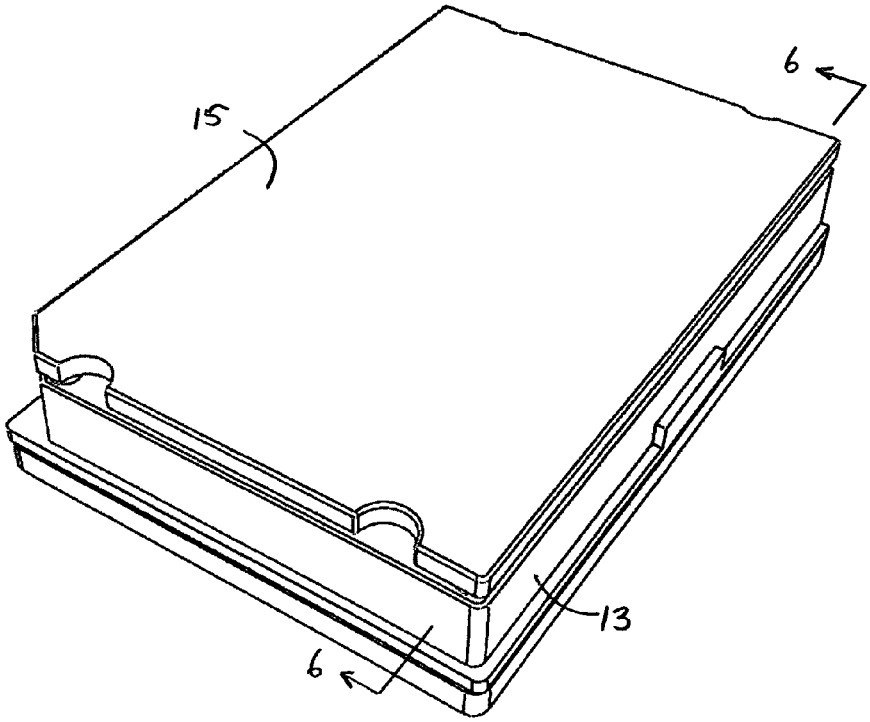

As seen most clearly in FIG. 3, a plurality of vertical projections, or latches, 39 extend orthogonally out from bottom surface 35 of plate 31, each latch 39 being represented herein as having a compressible, arrowhead-style design. Preferably, plate 31 and latches 39 are integrally formed together out of a plastic material through conventional molding techniques. As will be described further below, each latch 39 is dimensioned to snap-mount through a corresponding hole 29 in microplate 13. In this manner, lid 15 can be used to cover microplate 13, as seen most clearly in FIGS. 4(*a*) and 4(*b*).

Figure 6A:
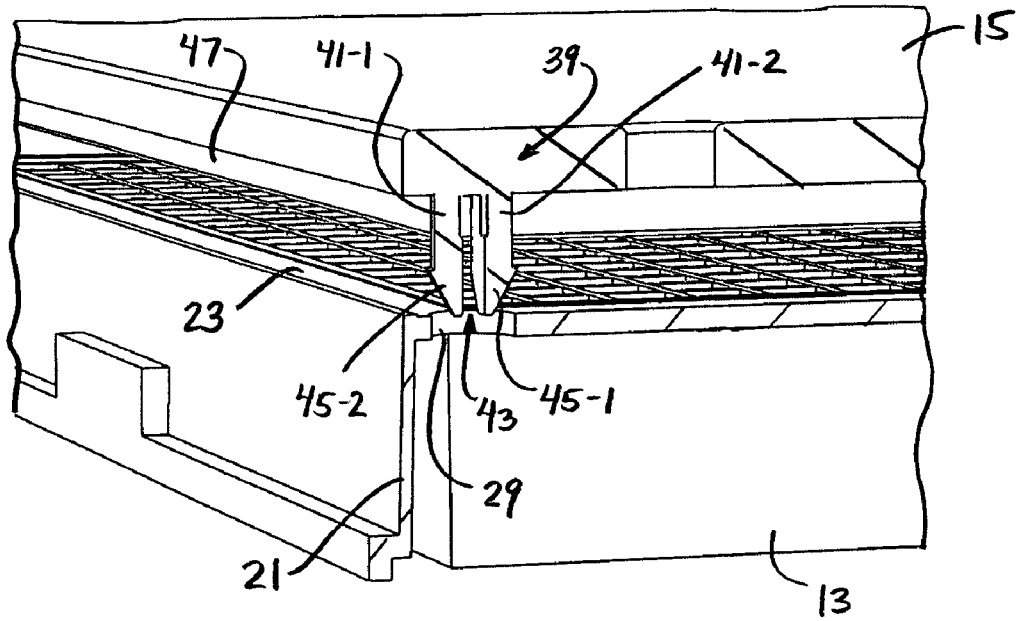
FIGS. 6(*a*)-(*c*) are fragmentary section views of the microplate and lid shown in FIG. 4(*b*), taken along lines 6-6, at various stages during the process of mounting the lid onto the microplate.
Figure 6B:
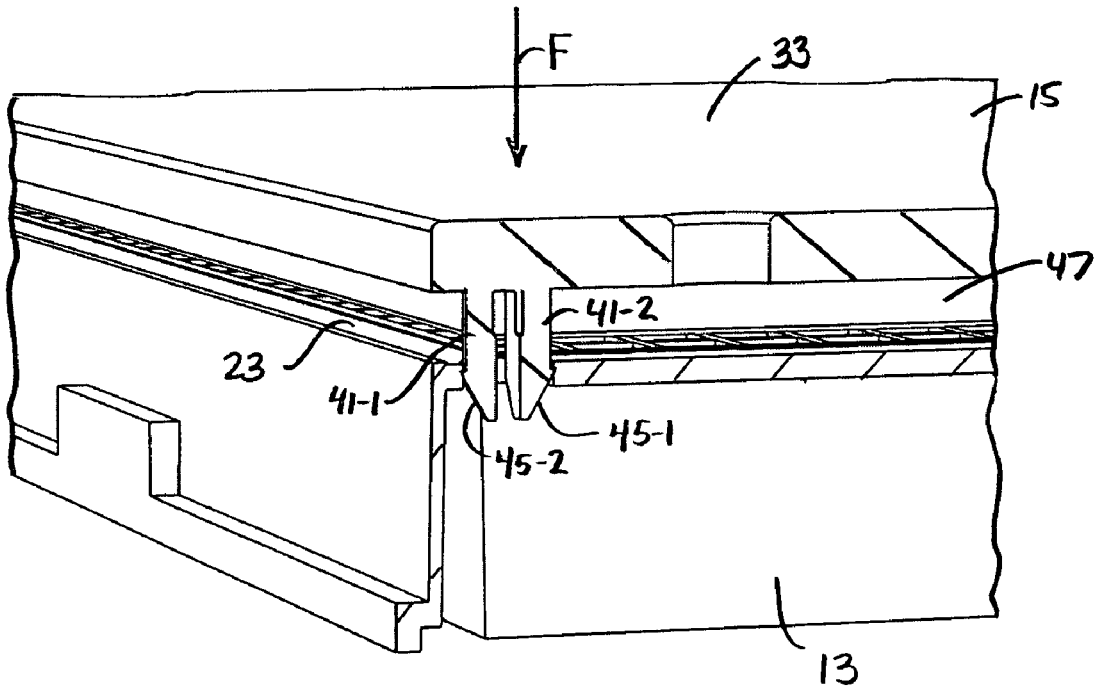
Figure 6C:
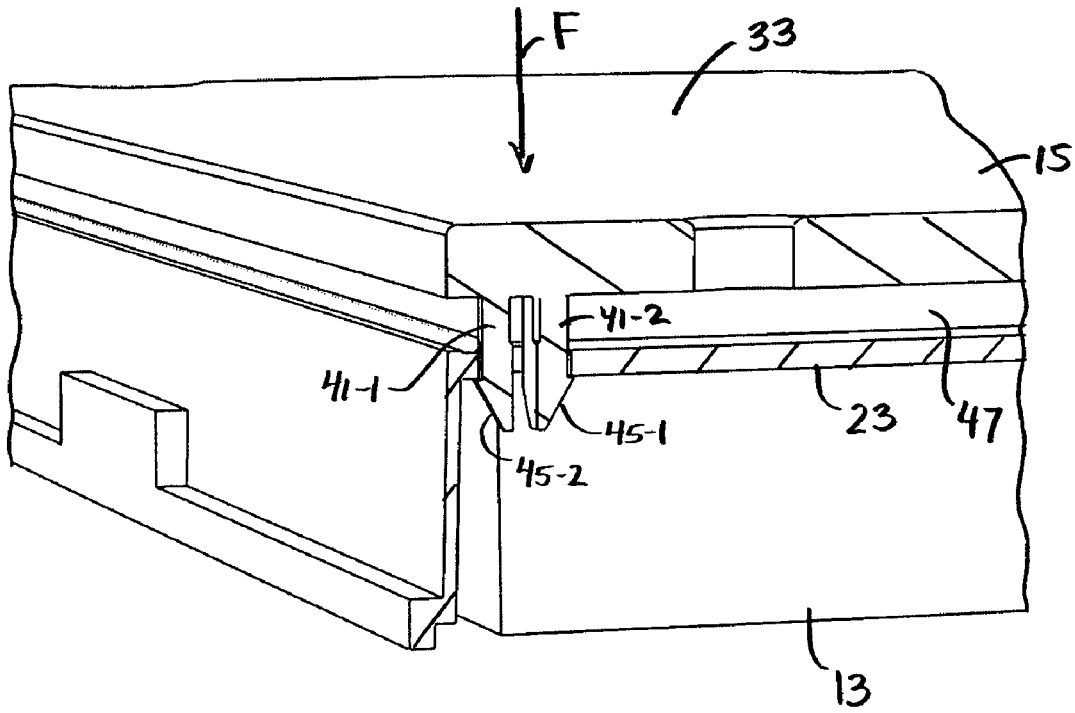
Figure 7A:
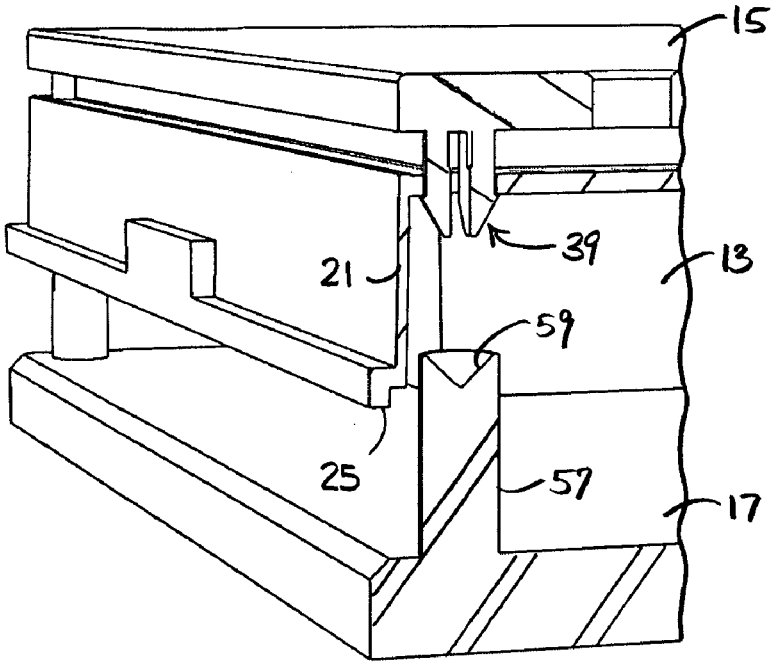
FIGS. 7(*a*)-(*d*) are fragmentary section views of the microplate kit shown in FIG. 1, taken along lines 7-7, at various stages during the process of removing the lid from the microplate using the lid removal tool.
Figure 7B:
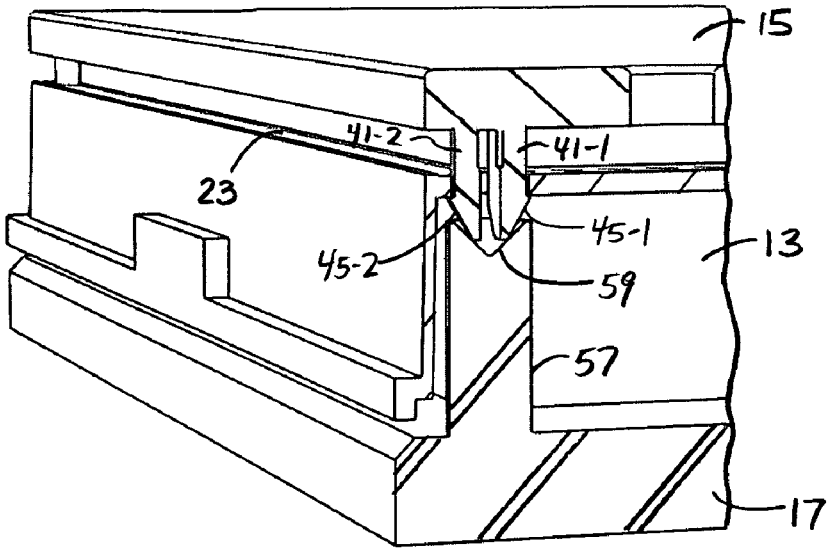
Figure 7C:
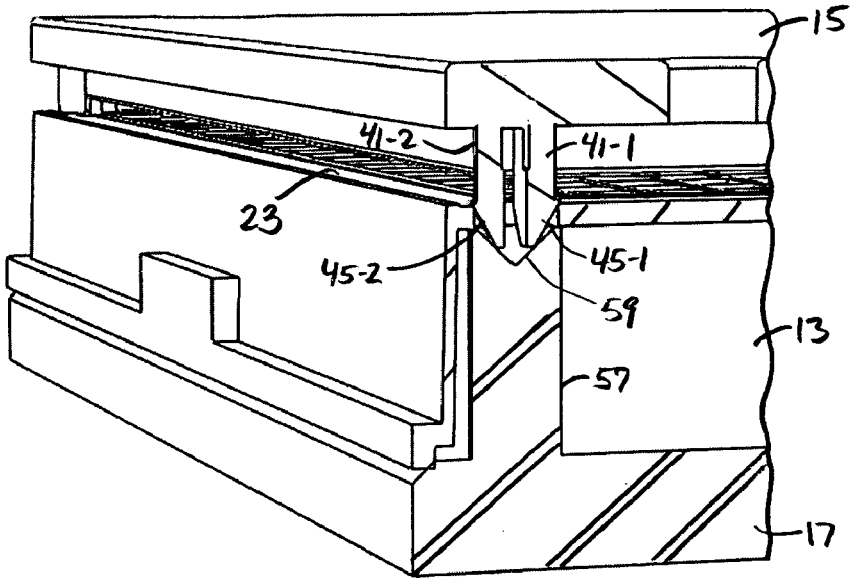
Figure 7D:
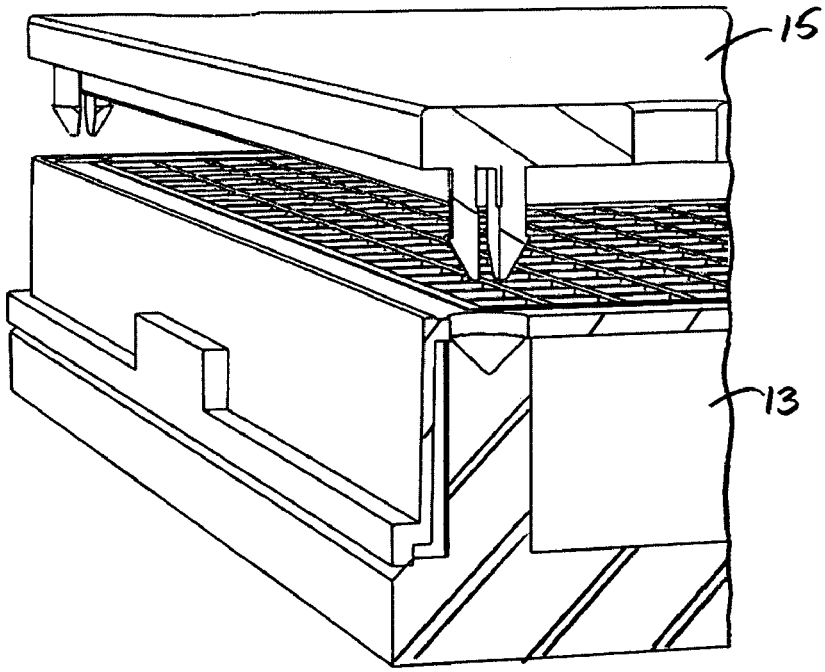

As seen most clearly in FIG. 6(*a*), each latch 39 is shaped to include a pair of semi-cylindrical legs 41-1 and 41-2 which are spaced slightly apart from one another so as to define a narrow slot 43 therebetween. A pair of outwardly extending barbs 45-1 and 45-2 are formed on the free ends of legs 41-1 and 41-2, respectively, the function of each barb 45 to become apparent below.

Referring back to FIG. 3, an open rectangular gasket 47 is affixed to bottom surface 35 in close proximity to the periphery of lid 15. Gasket 47 is preferably constructed out of a highly compliant, chemical resistant material. Accordingly, as lid 15 is mounted on microplate 13, gasket 47 is disposed firmly in contact against top surface 23, as seen most clearly in FIGS. 5(*a*) and 5(*b*). Preferably, lid 15 is mounted on microplate 13 with such force that gasket 47 compresses considerably, with latches 39 engaging microplate 13 to retain lid 15 firmly mounted on microplate 13. In this manner, it is to be understood that together gasket 47 and plate 31 effectively seal off wells 19 from the outside environment, which is highly desirable.

Gasket 47 is represented herein as having an O-ring style (i.e., an open rectangular configuration that extends along the periphery of plate 31). In this manner, each well 19 is sealed off from the outside environment but is remains in fluid communication with the remaining wells 19 in microplate 13, as seen most clearly in FIG. 5(*b*). Accordingly, it is to be understood that alternative styles of gaskets could be used in place thereof without departing from the spirit of the present invention. For example, gasket 47 could be replaced by a single sheet gasket (i.e., a solid, or closed, rectangular gasket) that would serve to seal off each individual well 19 in microplate 13, which may be desirable in certain applications.

Referring now to FIGS. 6(*a*)-(*c*), there is shown a section view of microplate 13 at various stages during the process of mounting lid 15 thereon. In the first step of the lidding process, lid 15 is positioned above microplate 13 with each latch 39 disposed in coaxial alignment with a corresponding hole 29 in top surface 23 of microplate 13, as shown in FIG. 6(*a*).

Aligned as such, a downward force F is applied onto top surface 33 of lid 15 using manual or automated means, as shown in FIG. 6(*b*). The downward force applied to lid 15 urges barbs 45-1 and 45-2 of each latch 39 into direct contact against the portion of top surface 23 that immediately surrounds each hole 29. Due to the inclusion of slot 43, the downward force causes each latch 39 to compress to the extent necessary so that barbs 45-1 and 45-2 can pass through each hole 29.

As seen most clearly in FIG. 6(*c*), the continued application of force F onto top surface 33 of lid 15 ultimately causes barbs 45-1 and 45-2 to penetrate entirely through hole 29. At this point, legs 41-1 and 41-2 of each latch 39 snap resiliently back into their original configuration, with barbs 45-1 and 45-2 of each latch 39 firmly engaged against the underside of top surface 23. In this manner, it is to be understood that latches 39 serve to lockably retain lid 15 tightly in place on microplate 13, which is highly desirable.

As can be appreciated, the particular design of lid 15 introduces a number of notable advantages over prior art methods of sealing microplates.

As a first benefit, microplate lid 15 is relatively inexpensive to manufacture. To the contrary, many well-known microplate lids and sealing methods use either expensive materials (e.g., metals) or have complex designs.

As a second benefit, the snap-fastening engagement means between microplate 13 and lid 15 renders the above-described lidding process easy to accomplish. Furthermore, because the above-described lidding process requires only (i) the proper orientation of lid 15 relative to microplate 13 and (ii) the application of a suitable force F onto lid 15, microplate 13 and lid 15 can be easily integrated into existing automated systems.

As a third benefit, the above-described design of lid 15 can be used in conjunction with a wide range of different microtitre plate sizes and densities, thereby increasing its range of potential applications.

As a fourth benefit, the particular design of lid 15 does not serve to increase the overall footprint (i.e., length and width) of the microplate 13, thereby rendering said components usable in most, if not all, preexisting automated systems.

As noted briefly above, tool 17 is designed to assist in the removal (i.e., or delidding) of lid 15 from microplate 13. Referring back to FIG. 1, tool 17 comprises a rigid, rectangular base 51 with the same approximate footprint as microplate 13, base 51 comprising a substantially flat top surface 53 and a substantially flat bottom surface 55.

Tool 17 additionally includes a plurality of support members, or posts, 57 which extend orthogonally away from top surface 53, posts 57 being located on base 51 in such a manner so that each post 57 coaxially aligns with a corresponding hole 29 in microplate 13, as will be described further below. It is to be understood that the free end of each post 57 is provided with an inwardly sloped, or concave, surface 59 which appears conical in lateral cross-section, as seen most clearly in FIG. 7(*a*), the function of concave surface 59 to become apparent below.

Referring now to FIGS. 7(*a*)-(*d*), there is shown a section view of kit 11 at various stages during the process of removing lid 15 from microplate 13 using lid removal tool 17. With lid 15 firmly mounted on microplate 13 as described in detail above, tool 17 is positioned beneath microplate 13 in such a manner so that each post 57 projects up through substantially open bottom surface 25 in sidewall 21 and into direct coaxial alignment with a corresponding latch 39 on lid 15, as shown in FIG. 7(*a*).

Aligned as such, microplate 13 is drawn down onto tool 17 until barbs 45-1 and 45-2 of each latch 39 directly contact concave surface 59 of a corresponding post 57 on tool 17, as shown in FIG. 7(*b*). At this time, a suitable downward force is applied to top surface 23 of microplate 13 (e.g., through notches 37) using manual or automated means. This downward force causes barbs 45-1 and 45-2 of each latch 39 to slide inward along concave surface 59 which in turn causes legs 41-1 and 41-2 to flex slightly inward (i.e., compressing latch 39).

As seen most clearly in FIG. 7(*c*), the continued application of a downward force on top surface 23 of microplate 13 ultimately causes legs 41 of each latch 39 to flex inward to the extent necessary so that their corresponding barbs 45 disengage from the underside of top surface 23. This disengagement causes the barbs 45 for each latch 39 to withdraw from its associated hole 29 in microplate 13 and thereby release lid 15 from microplate 13. Disengaged lid 15 can then be fully separated from microplate 13 using either manual or automated means, as shown in FIG. 7(*d*). In this manner, it is to be understood that lid 15 can be repeatedly mounted/released from microplate 13 as deemed necessary, which is a principal object of the present invention.

Figure 8:
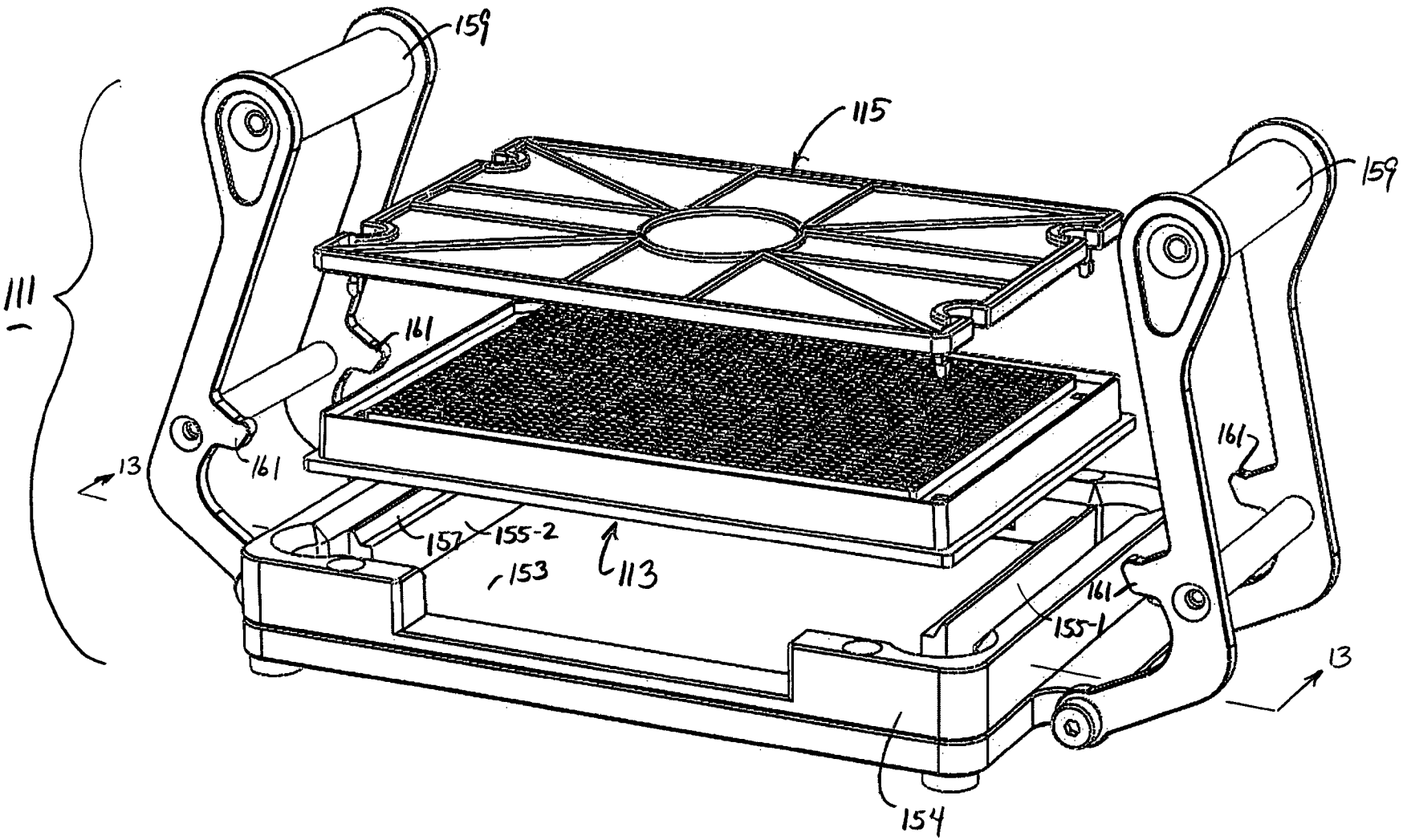
FIG. 8 is an exploded, top perspective view of a second embodiment of a microplate kit constructed according to the teachings of the present invention.

Referring now to FIG. 8, there is shown an exploded, top perspective view of a second embodiment of a microplate kit that is constructed according to the teachings of the present invention and identified generally by reference numeral 111.

Microplate kit 111 is similar to microplate kit 11 in that microplate kit 111 comprises a microplate 113, a lid 115 designed to be removably mounted onto microplate 113 and a tool 117 designed to assist in the removal of lid 115 when mounted on microplate 113.

Figure 9:
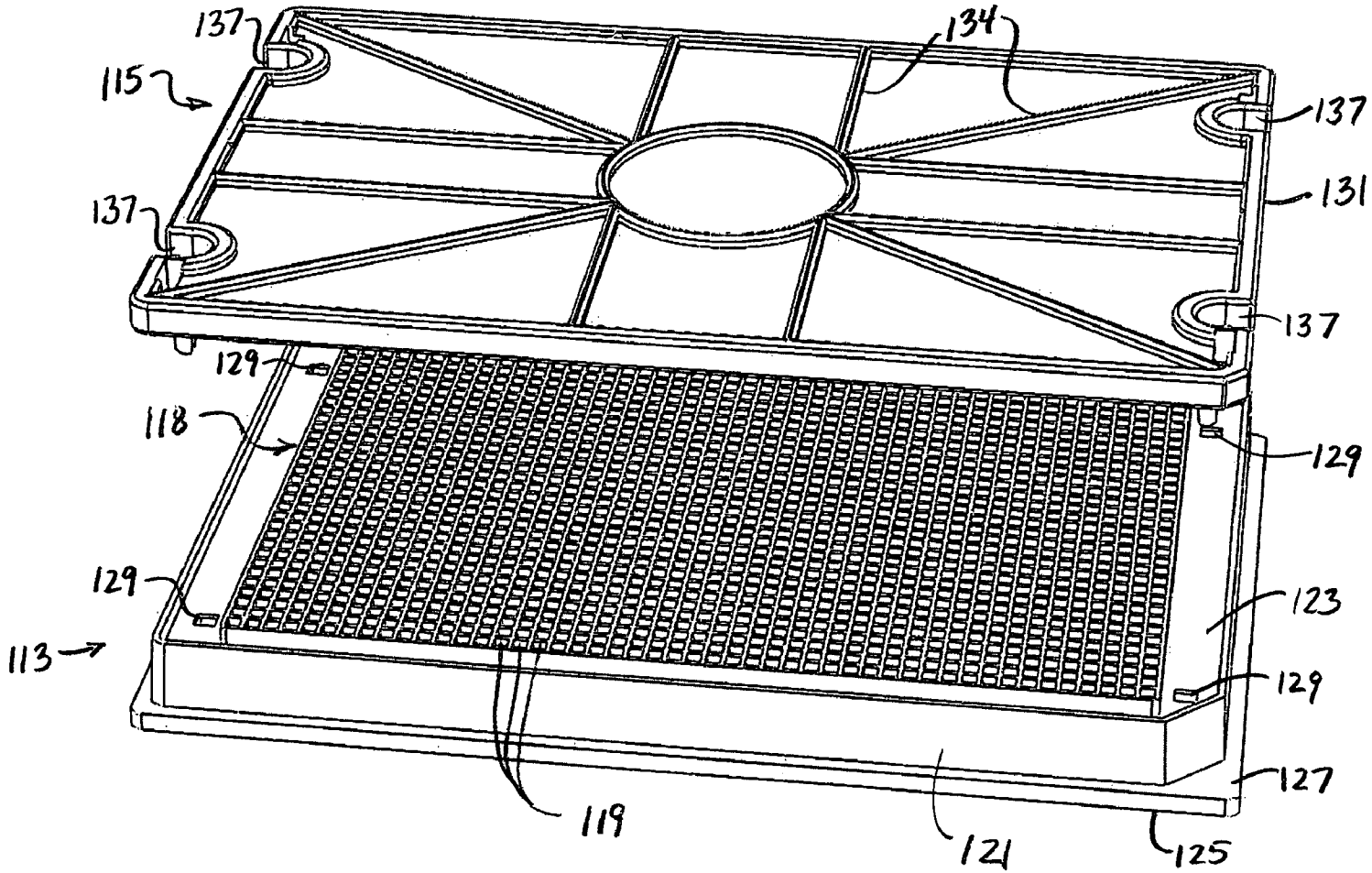
FIG. 9 is an exploded, top perspective view of the microplate and lid shown in FIG. 8.

Referring now to FIG. 9, microplate 113 is similar to microplate 13 in that microplate 113 is generally block-shaped in its design and includes an enlarged sample area 118 that is provided with a plurality of individual, vertically-disposed wells 119. Microplate 113 similarly includes a hollow outer frame, or sidewall, 121 that is formed directly around the periphery of sample area 118, sidewall 121 having an inverted U-shaped configuration in lateral cross-section (as seen most clearly in FIG. 12(*a*)). Specifically, sidewall 121 is shaped to define a thin, substantially flat top surface 123, a substantially open bottom surface 125 and an outwardly extending registration edge, or flange, 127 along bottom surface 125. Furthermore, sidewall 121 is additionally shaped to define a plurality of vertical holes 129 in top surface 123, with one hole 129 located in each corner of sidewall 121, as seen most clearly in FIG. 9.

It should be noted that microplate 113 differs from microplate 13 principally in that (i) microplate 113 includes a higher density of wells 119 (notably, 1536 wells as opposed to 384 wells in microplate 13) and (ii) microplate 113 includes holes 129 which are generally rectangular in lateral cross-section (as opposed to the circular holes 29 in microplate 13).

Figure 10:
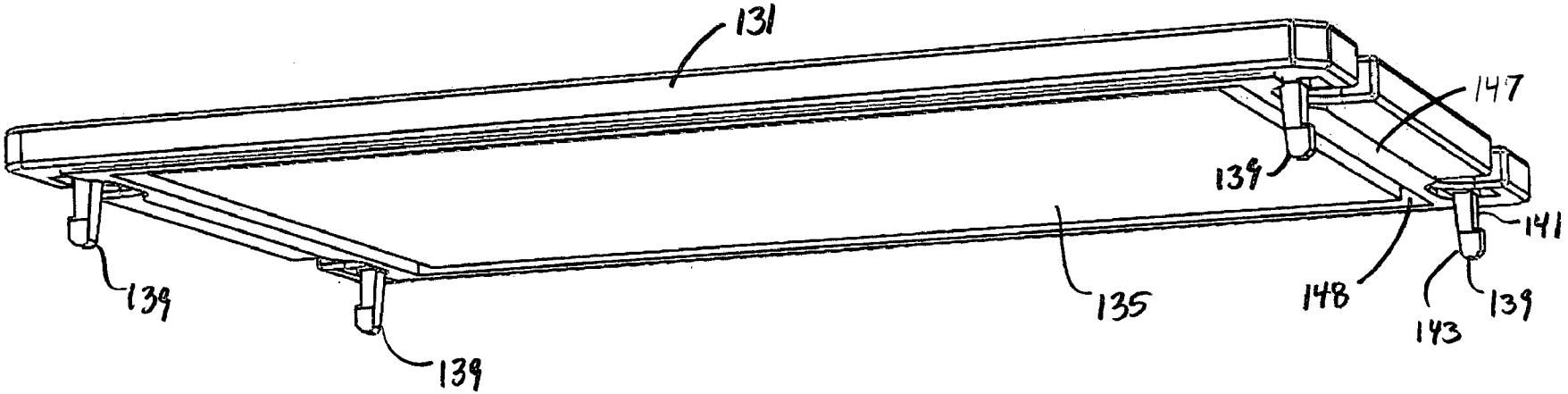
FIG. 10 is a bottom perspective view of the lid shown in FIG. 9.
Figure 12A:
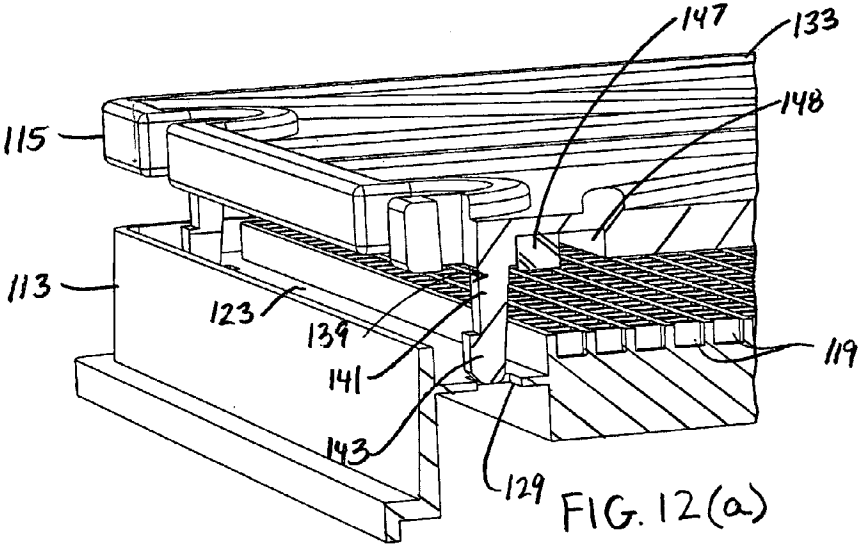
FIGS. 12(*a*)-(*c*) are fragmentary section views of the microplate and lid shown in FIG. 11, taken along lines 12-12, at various stages during the process of mounting the lid onto the microplate.
Figure 12B:
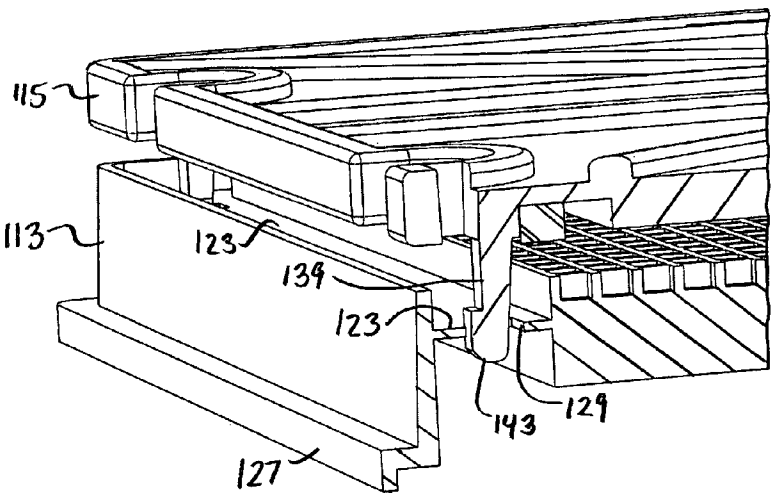
Figure 12C:
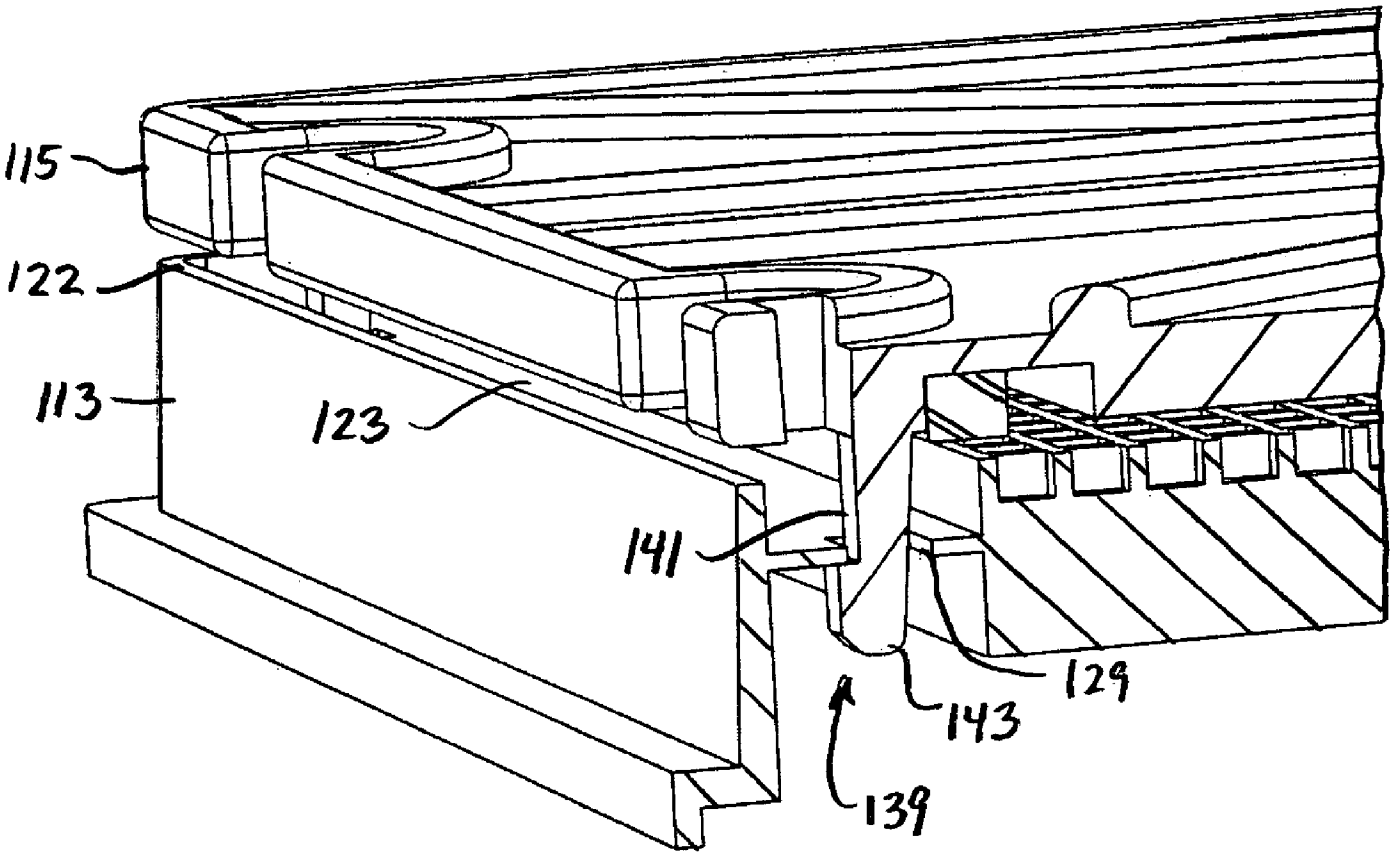
Figure 13A:
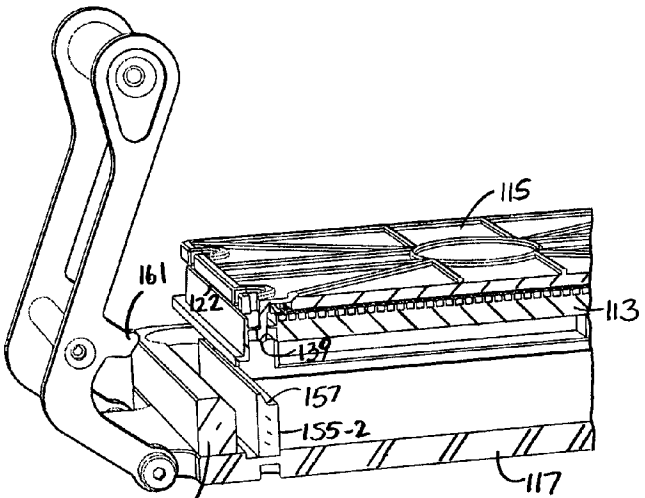
FIGS. 13(*a*)-(*d*) are fragmentary section views of the microplate kit shown in FIG. 8, taken along lines 13-13, at various stages during the process of removing the lid from the microplate using the lid removal tool.
Figure 13B:
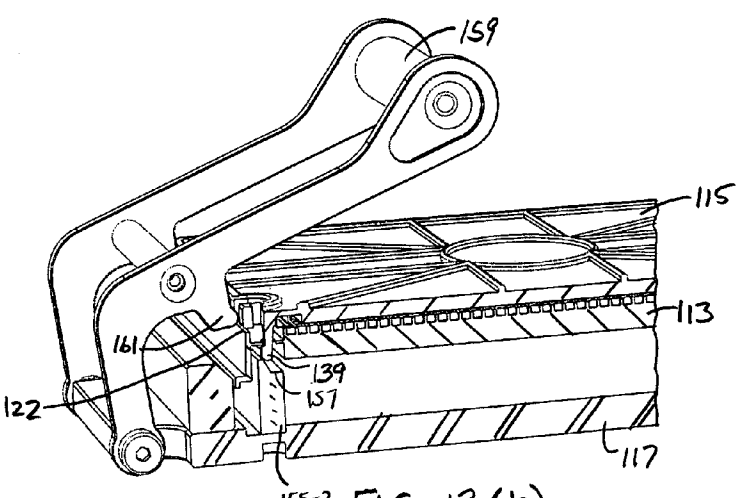
Figure 13C:
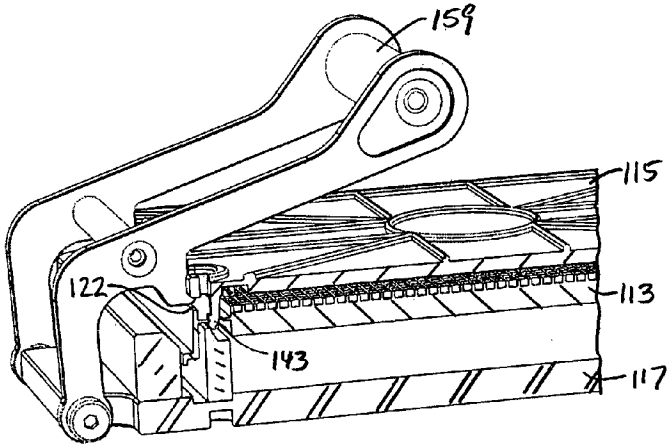
Figure 13D:
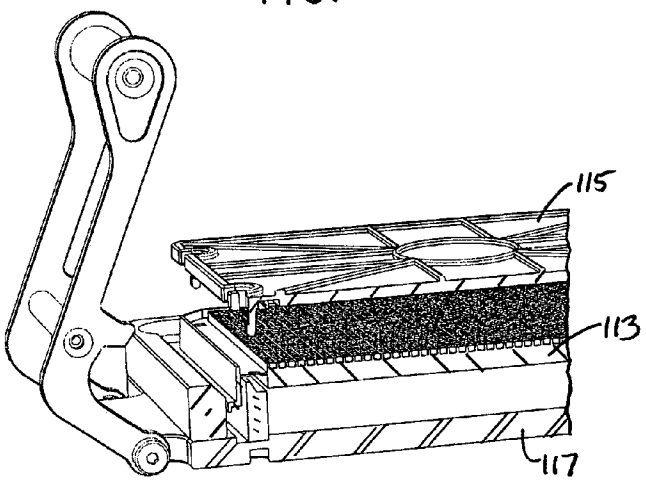

As seen most clearly in FIGS. 9, 10 and 12(*a*), lid 115 is similar to lid 15 in that lid 115 comprises a thin, generally rectangular plate 131 which includes a top surface 133, a bottom surface 135 and a plurality of arcuate notches 137 formed along its outer edge. It should be noted that the majority of top surface 133 is preferably recessed to reduce the amount of plastic required for its construction. A plurality of strengthening ribs 134 is preferably formed into top surface 133 to provide lid 115 with the necessary structural rigidity.

Lid 115 differs from lid 15 principally in that lid 115 comprises a plurality of vertical projections, or latches, 139 which are different in construction than latches 39. Specifically, each latch 139 is represented herein as being in the form of a single, deflectable arm 141 which extends orthogonally out from bottom surface 135 of plate 31, the free end of each arm 141 being shaped to include an enlarged engagement barb 143. In use, latches 139 operate in a similar manner as latches 39 in that latches are dimensioned to snap-mount through corresponding openings 129 in microplate 113, as will be described further in detail below.

Figure 11:
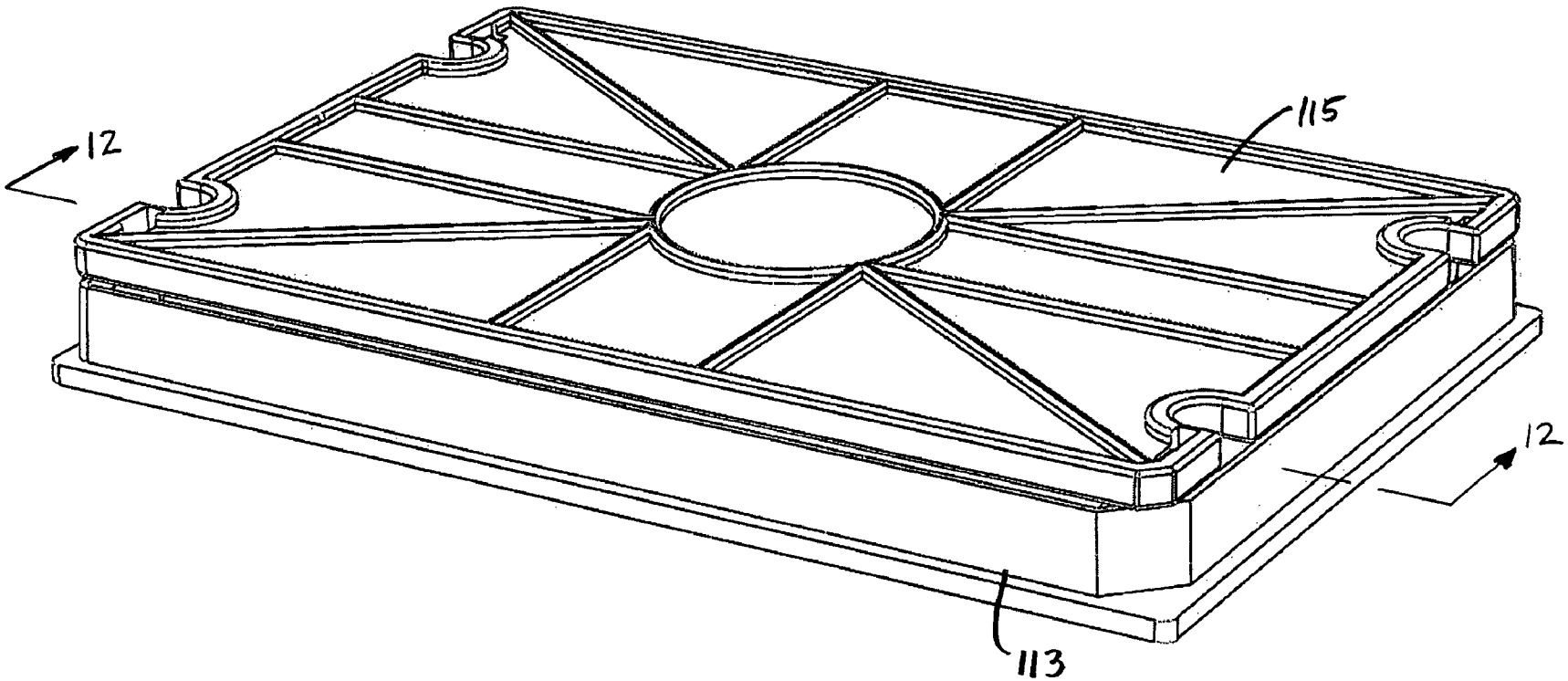
FIG. 11 is a top perspective view of the microplate and lid shown in FIG. 9, the lid being shown mounted on the microplate.

As seen most clearly in FIGS. 10 and 12(*a*), an open rectangular gasket 147 is secured within a corresponding rectangular groove 148 formed in bottom surface 135. Gasket 147 is similar to gasket 47 in that, with lid 115 is mounted on microplate 113 (as represented in FIG. 11), gasket 147 compresses to the extent necessary to adequately seal wells 119 from the outside environment.

Referring now to FIGS. 12(*a*)-(*c*), there is shown a section view of microplate 113 at various stages during the process of mounting lid 115 thereon. In the first step of the lidding process, lid 115 is positioned above microplate 113 with each latch 139 disposed in coaxial alignment with a corresponding hole 129 in top surface 123 of microplate 113, as shown in FIG. 12(*a*).

Aligned as such, a downward force is applied onto top surface 133 of lid 115. The downward force applied to lid 115 deflects each latch 139 inward to the extent necessary for its enlarged barb 143 to insert into its corresponding hole 129 in microplate 113, as seen in FIG. 12(*b*). The continued application of downward force onto top surface 133 of lid 115 ultimately causes barb 143 of each latch 139 to penetrate entirely through its corresponding hole 129. Once barb 143 of each latch 139 passes through its corresponding hole 129, latch 139 resiliently snaps back into its original configuration, with barb 143 firmly engaged against the underside of top surface 123, as shown in FIG. 12(*c*). In this manner, it is to be understood that latches 139 are similar in function with latches 39 in that latches 139 serve to lockably retain lid 115 tightly in place on microplate 113, which is highly desirable.

Tool 117 functions in a similar manner as tool 17 in that tool 117 can be used to deflect latches 139 inward to the extent necessary so that lid 115 can be disengaged and subsequently removed from microplate 113. Referring back to FIG. 8, tool 117 comprises a flat, rectangular base 153 and an upstanding sidewall 154 formed along the periphery of base 153. A pair of elongated support members 155-1 and 155-2 project orthogonally upward from opposite ends of the top surface of base 153, each support member 155 being shaped to include an angled, or tapered, top surface 157. In addition, a pair of opposing handles 159 are pivotally connected to base 153, each handle 159 being shaped to include a pair of inwardly protruding fingers 161, the function of fingers 161 to become apparent below.

Referring now to FIGS. 13(*a*)-(*d*), there is shown a section view of kit 111 at various stages during the process of removing lid 115 from microplate 113 using lid removal tool 117. With lid 115 firmly mounted on microplate 113 as described in detail above, tool 117 is positioned beneath microplate 113 in such a manner so that top surface 157 of each support member 155 is disposed in direct alignment beneath a corresponding pair of latches 139 on lid 115, as shown in FIG. 13(*a*).

Aligned as such, microplate 113 is drawn down onto tool 117 until barb 143 of each latch 139 rests directly upon a support member 155. With microplate 113 supported by tool 117, handles 159 are pivoted inward (either manually or automatically) until fingers 161 abut against a thin outer wall 122 on microplate 113 that protrudes vertically up from the periphery of top surface 123, as shown in FIG. 13(*b*). At this time, further pivotal displacement of handles 159 inward urges microplate 113 downward onto tool 117. This downward force causes enlarged barb 143 of each latch 139 to ride inwardly along tapered surface 157 of a support member 155 which in turn causes latches 139 to deflect (i.e., articulate) inward to the extent necessary that latches 139 disengage from the underside of top surface 123. This disengagement causes barb 143 of each latch 139 to withdraw from its associated hole 129 in microplate 113 and thereby release lid 115 from microplate 113, as shown in FIG. 13(*c*). Disengaged lid 115 can then be fully separated from microplate 113 using either manual or automated means, as shown in FIG. 13(*d*).

The embodiments shown in the present invention are intended to be merely exemplary and those skilled in the art shall be able to make numerous variations and modifications without departing from the spirit of the present invention. All such variations and modifications are intended to be within the scope of the present invention as defined in the appended claims.

What is claimed is:

1. A microplate kit comprising:

(a) a microplate, the microplate comprising a sample area shaped to define a plurality of individual wells for retaining specimens, wherein the microplate includes an opening outside the sample area;

(b) a lid adapted to be mounted on the microplate to enclose the plurality of individual wells, wherein the lid includes a projection dimensioned to project at least partially through the opening when the lid is mounted on the microplate, and (c) a tool, separate from the microplate and the lid, for disengaging the lid from the microplate when mounted thereon, wherein the tool comprises a base having a top surface and a bottom surface, a support member protruding up from the top surface of the base, and a handle pivotally connected to the base and wherein a tapered free end of the support member is designed to engage the latch of the lid to deflect the latch when the microplate is urged down upon the tool.

2. The microplate kit as claimed in claim 1 wherein the projection matingly engages the microplate upon insertion through the opening.

3. The microplate kit as claimed in claim 2 wherein the microplate further comprises an outer frame forming an inverted U-shaped channel directly around the sample area, the channel having a top surface substantially co-planar with the sample area and the opening extending through the top surface of the inverted U-shaped channel.

4. The microplate kit as claimed in claim 3 wherein the inverted U-shaped channel includes a substantially open bottom, the opening in the top surface being accessible through the open bottom.

5. The microplate kit as claimed in claim 3 wherein the lid comprises a generally rectangular plate having a top surface and a bottom surface.

6. The microplate kit as claimed in claim 5 wherein the footprint of the lid is substantially equal to the footprint of the microplate.

7. The microplate kit as claimed in claim 5 wherein the projection is in the form of a latch which protrudes orthogonally out from the bottom surface of the lid.

8. The microplate kit as claimed in claim 7 wherein, with the lid mounted on the microplate, the latch at least partially projects through the opening in the microplate and matingly engages the outer frame.

9. The microplate kit as claimed in claim 8 wherein the latch is in the form of a compressible arrowhead which includes a pair of legs spaced apart from one another so as to define a narrow slot therebetween, a free end of each leg being shaped to include an outwardly extending barb.

10. The microplate kit as claimed in claim 8 wherein the latch is in the form of a single deflectable arm with an outwardly extending barb formed on a free end of the deflectable arm.

11. The microplate kit as claimed in claim 5 wherein the lid further comprises a gasket affixed to the lid, the gasket protruding out beyond the bottom surface of the lid.

12. The microplate kit as claimed in claim 3 wherein with the tool disposed beneath the microplate, a free end of the support member extends through the opening in the inverted U-shaped channel and supports the latch of the lid that is mounted on the microplate.

13. The microplate kit as claimed in claim 1 wherein the handle is shaped to include a finger that is dimensioned to selectively contact the microplate.

14. The microplate kit as claimed in claim 1 wherein the microplate includes at least four openings, each opening positioned in a corner of the microplate; and the lid includes at least four projections, each projection positioned in a corner of the lid.

15. The microplate kit as claimed in claim 11 wherein the gasket is an O-ring gasket having an open rectangular shape and positioned along the periphery of the lid.

16. The microplate kit as claimed in claim 13 wherein a top surface of the lid includes at least one notch through which the finger of the handle can extend to contact the microplate.

17. A microplate kit comprising:

a microplate comprising a sample area shaped to define a plurality of individual wells for retaining specimens, the microplate further including:

an inverted U-shaped channel around the sample area, the channel having a top surface substantially coplanar with the sample area, and a substantially open bottom; and an opening extending through the top surface of the channel, the opening in the top surface being accessible through the open bottom of the channel;

a lid for mounting on the microplate to enclose the plurality of individual wells, wherein the lid includes a projection dimensioned to project at least partially through the opening to matingly engage the microplate when the lid is mounted on the microplate; and a tool, separate from the microplate and the lid, for disengaging the lid from the microplate when mounted thereon, wherein the tool comprises a base having a top surface and a bottom surface, a support member protruding up from the top surface of the base, and a handle pivotally connected to the base; and wherein a tapered free end of the support member is designed to engage the latch of the lid to deflect the latch when the microplate is urged down upon the tool.

* * * * *